US011988440B2

(12) United States Patent
Wainauski et al.

(10) Patent No.: US 11,988,440 B2
(45) Date of Patent: May 21, 2024

(54) MULTI-CHAMBERED WATER TANK FOR CONFINED SPACES IN A REFRIGERATION APPLIANCE

(71) Applicants: BSH Home Appliances Corporation, Irvine, CA (US); BSH Hausgeräte GmbH, Munich (DE)

(72) Inventors: Conner Wainauski, Knoxville, TN (US); Jorge Carlos Montalvo Sanchez, Knoxville, TN (US); Nilton Bertolini, Clinton, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/891,177

(22) Filed: Aug. 19, 2022

(65) Prior Publication Data

US 2023/0266056 A1 Aug. 24, 2023

Related U.S. Application Data

(60) Provisional application No. 63/312,946, filed on Feb. 23, 2022.

(51) Int. Cl.
*F25D 23/12* (2006.01)

(52) U.S. Cl.
CPC ..... *F25D 23/126* (2013.01); *F25D 2323/122* (2013.01)

(58) Field of Classification Search
CPC ..... F25D 2323/122; F25D 23/126; B67D 3/0067; B67D 1/0014; B67D 1/04; Y10T 137/8622; Y10T 137/86228
See application file for complete search history.

(56) References Cited

U.S. PATENT DOCUMENTS

| | | | | |
|---|---|---|---|---|
| 2,477,210 | A | 7/1949 | Skinner | |
| 3,511,415 | A | 5/1970 | Crowe | |
| 3,834,178 | A | 9/1974 | Pink | |
| 4,036,620 | A | 7/1977 | Benasutti et al. | |
| 5,315,845 | A | 5/1994 | Lee | |
| 5,542,264 | A | 8/1996 | Hortin et al. | |
| 6,079,221 | A | 6/2000 | Senner | |
| 8,431,067 | B2 | 4/2013 | Rowley et al. | |
| 8,726,685 | B2 | 5/2014 | An | |
| 9,631,859 | B2 | 4/2017 | Park | |
| 10,088,217 | B2 | 10/2018 | Baeuerle et al. | |
| 10,422,574 | B1 | 9/2019 | Gardner et al. | |
| 2011/0126577 | A1* | 6/2011 | An | B29C 45/00 222/129 |
| 2012/0096888 | A1* | 4/2012 | Park | F25D 23/126 220/592.02 |

* cited by examiner

*Primary Examiner* — Cassey D Bauer
(74) *Attorney, Agent, or Firm* — Michael E. Tschupp; Andre Pallapies; Brandon G. Braun

(57) ABSTRACT

A system can include a fluid tank for a refrigeration appliance. The fluid tank can include a plurality of chambers. Each chamber of the plurality of chambers can include an inlet port and an outlet port. At least part of the outlet port can be on a horizontal plane that is offset in an upward direction with respect to the inlet port. At least two chambers of the plurality of chambers can be fluidly coupled in series.

17 Claims, 8 Drawing Sheets

MULTI-CHAMBERED WATER TANK FOR CONFINED SPACES IN A REFRIGERATION APPLIANCE

CROSS REFERENCE TO RELATED APPLICATION

This claims priority to U.S. Ser. No. 63/312,946 titled "Multi-Chambered Water Tank for a Refrigeration Appliance" and filed Feb. 23, 2022, the entirety of which is incorporated herein by reference.

TECHNICAL FIELD

The present disclosure relates generally to refrigeration systems and, more particularly (although not necessarily exclusively), to fluid tanks assembled in refrigeration systems.

BACKGROUND

Refrigerators can include a fluid tank. For example, a refrigerator may include a water tank to support a built-in water dispenser or an automatic ice maker. The presence of the water tank within the refrigerator can lead to challenges in refrigerator design. The water tank can intrude on the internal capacity and usable space within the refrigerator. Air entrapment inside the water tank can cause water sputtering and dripping when a user dispenses water from the refrigerator. Temperature fluctuations in dispensed water can occur due to water circulation within the water tank. For example, water recirculation can occur as new water enters the water tank and mixes with cool water stored in the water tank.

DETAILED DESCRIPTION

Certain aspects and features of this disclosure relate to a multi-chambered water tank in a refrigeration appliance.

Each chamber within the multi-chambered water tank can have an inlet and an outlet, allowing the chamber to couple to another chamber to form chambers fluidly coupled in series. The multi-chambered water tank can have a square cross-section, a rectangular cross-section, or any other cross-section with a substantially flat shape. A cross-section with a substantially flat shape can lead to at least one flat chamber surface. A flat surface of the water tank can increase the area exposed to refrigerator cold air. In some examples, the multi-chambered water tank may be stored in a space near the top of a refrigeration unit, which may allow for more usable room in the refrigeration appliance.

In one example, the multi-chambered water tank is positioned at the top of the refrigerator in a space with a small maximum height limitation (e.g., 25 mm). The water tank includes multiple, substantially identical chambers connected in series. The outlet of a prior chamber can couple to the inlet of the next chamber. The inlet of the chamber can be positioned at a lower elevation as compared to the outlet of the chamber to allow air to purge horizontally. A top surface of each chamber can be angled from bottom to top and act as a guide for air purging towards the outlet of the tank.

Connection channels can couple adjacent chambers. The connection channels can have reduced cross section as compared to the main body of the chamber to accelerate the flow of fluid (e.g., air or water), pushing the fluid into the next chamber. Because each chamber itself can have a small capacity for fluid, water recirculation in the water tank can be minimized. The water tank can be substantially flat, which can increase the area exposed to the refrigerator cold air. Any number of individual chambers can be included to meet capacity needs. In one example, the water tank includes twelve chambers. And, in other examples, the water chamber may be positioned vertically or slanted relative to a vertical axis through the refrigerator, rather than horizontal.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Figure 1:
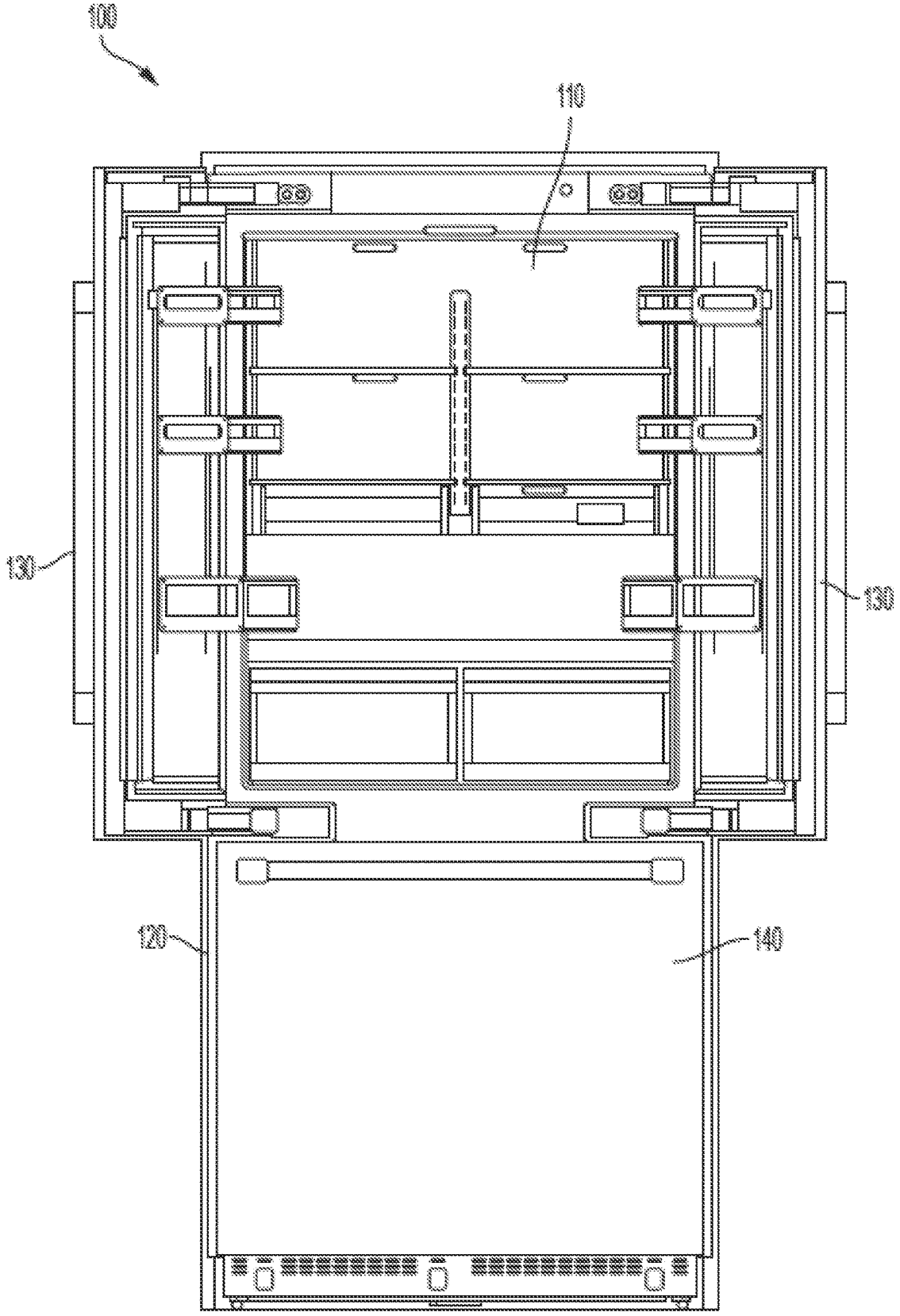
FIG. 1 is a schematic of a front view of a refrigerator that can include a water tank according to one example of the present disclosure.

FIG. 1 is a schematic of a front view of a refrigerator 100 that can include a water tank according to one example of the present disclosure. In some examples, the refrigerator 100 can be a bottom mount refrigerator. The refrigerator 100 can include a refrigerator or fresh food compartment 110 and a freezer compartment 120. Doors 130 are provided for the refrigerator compartment or fresh food compartment 110 and a door 140 is provided for the freezer compartment. One of the doors 130 can include an ice dispenser, which may also include a water dispenser. In some examples, an ice-making compartment can be provided in the fresh food compartment 110.

The water tank for dispensing chilled drinking water can be arranged in an interior of the refrigerator 100. In some examples, the water tank can be positioned horizontally at a top portion of the refrigerator 100, such as proximate to an inner liner of a top wall of the fresh food compartment 110. In other examples, the water tank can be positioned at other locations in the refrigerator 100 or positioned vertically at a different angle relative to an axis of the refrigerator 100.

And, although described herein as a water tank, other types of fluid tanks for containing liquids or gasses other than water may be used.

Figure 2:
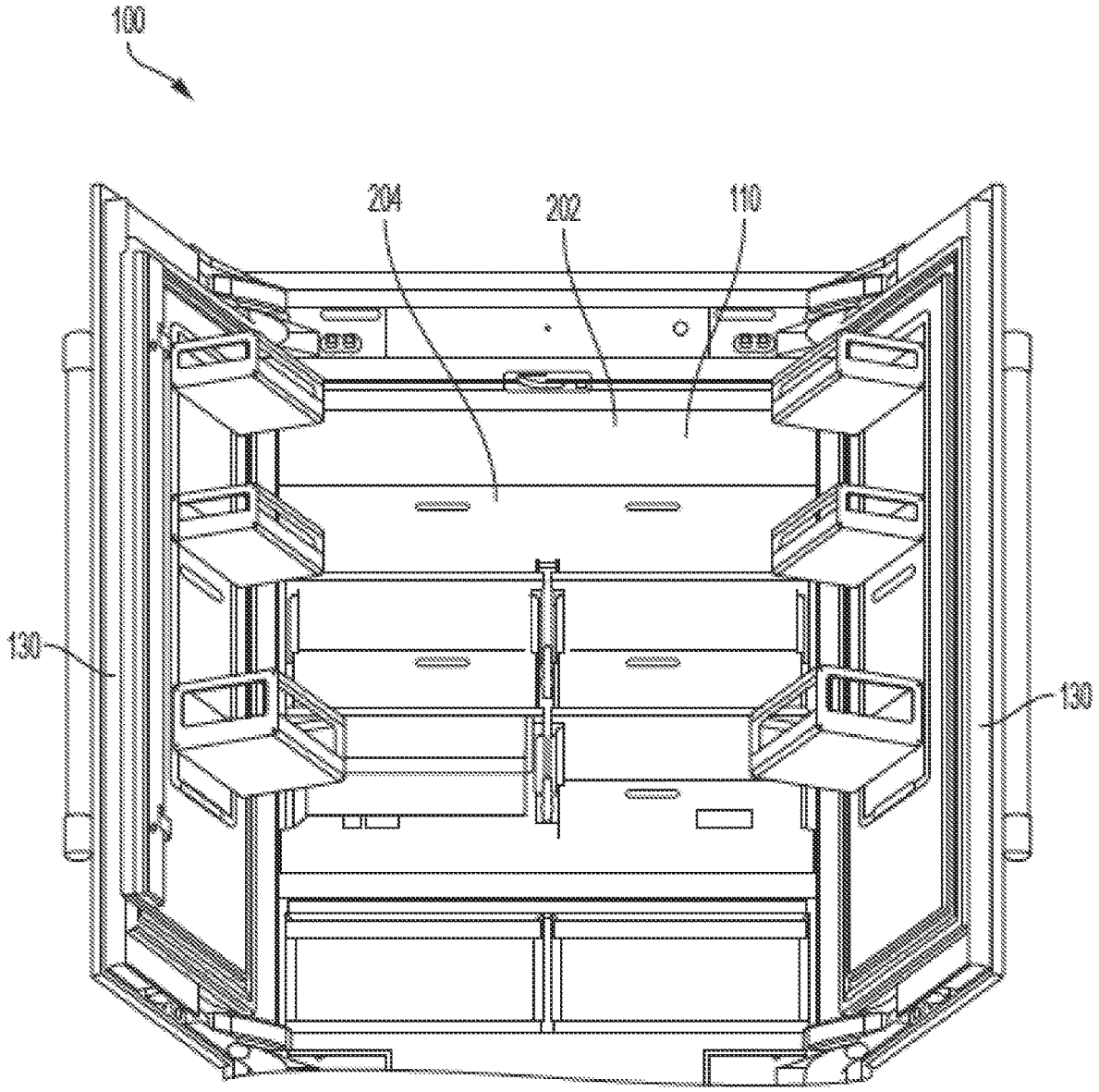
FIG. 2 is a schematic of a front view of an upper portion of a refrigerator that can include a water tank according to one example of the present disclosure.

FIG. 2 is a schematic of a front view of an upper portion of a refrigerator 100 that can include a water tank according to one example of the present disclosure. The refrigerator 100 depicted in FIG. 2 can be the refrigerator 100 from FIG. 1. Doors 130 of a fresh food compartment 110 are open to reveal an interior of the refrigerator 100. A top 202 of the fresh food compartment 110 represents a location in the refrigerator 100 where the water tank can be positioned. The water tank can be positioned horizontally and occupy an area of the refrigerator 100 to allow more room for contents to be placed in the refrigerator 100. In some examples, the water tank can be positioned vertically along a back wall 204 of the interior of the fresh food compartment 110. And, although described herein as a water tank, other types of tanks for containing liquids or gasses other than water may be used.

Figure 3A:
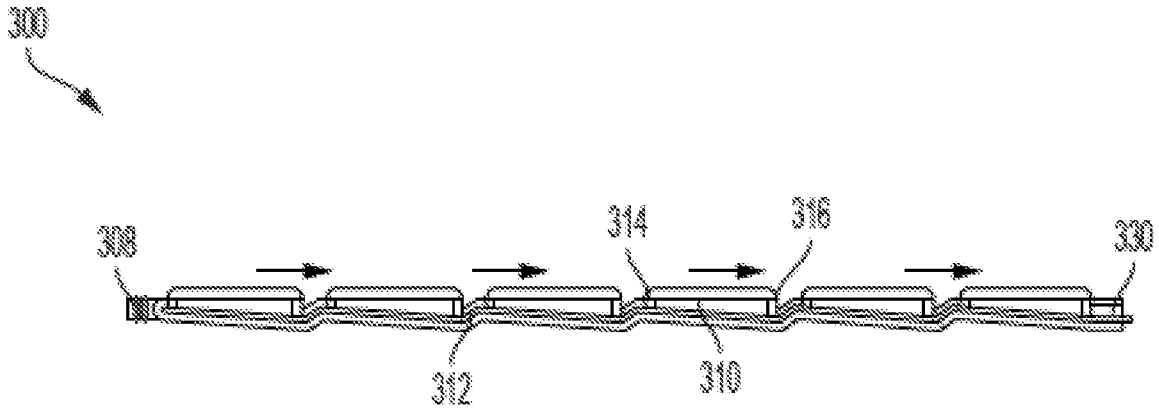
FIG. 3A is a schematic of a side view section of a water tank according to one example of the present disclosure.

FIG. 3A is a schematic of a side view section of a water tank 300 according to one example of the present disclosure. Arrows depict a direction of water flow within the water tank 300. The water tank 300 can be positioned in a horizontal plane in a refrigerator 100, such as the refrigerator 100 of FIG. 1 or FIG. 2. The water tank 300 includes a tank inlet 308, multiple chambers 310, and a link channel 330. Six chambers 310 are shown in FIG. 3A, though only one is associated with a numerical indicator in FIG. 3A.

Each chamber 310 can include a chamber inlet port 314, a chamber outlet port 316, and a housing defining a fluid-containing area in the chamber 310. In some examples, the tank inlet 308 is the chamber inlet port 314 of the front chamber 310. Each chamber 310 can be fluidly coupled to an immediately preceding or following chamber 310 by a connection channel 312 through at least one of the chamber inlet ports 314 or the chamber outlet ports 316.

Figure 3B:
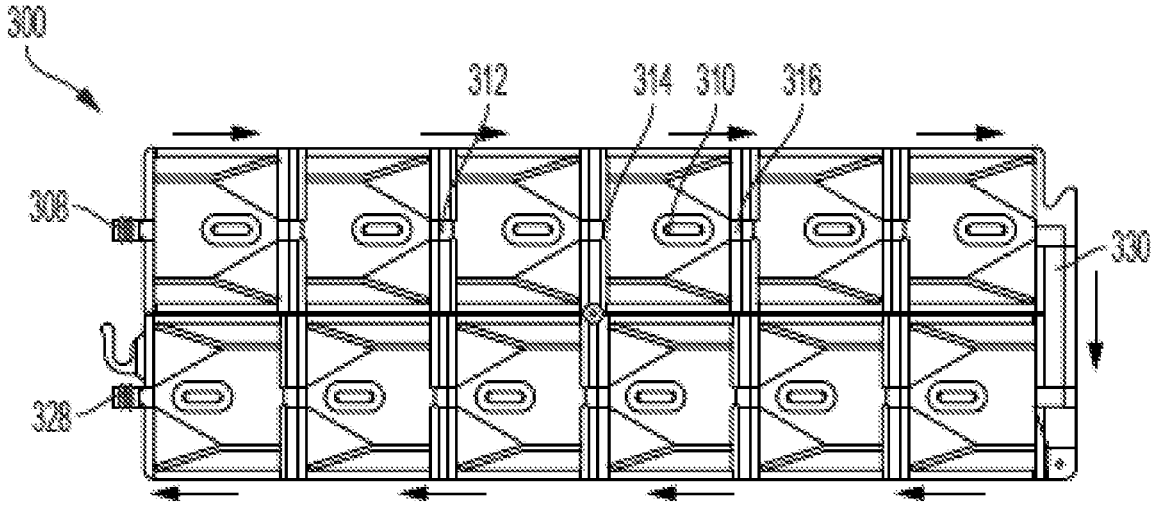
FIG. 3B is a schematic of a top view of the water tank according to one example of the present disclosure.

FIG. 3B is a schematic of a top view of the water tank 300 according to one example of the present disclosure. Arrows depict the direction of water flow within the water tank 300. The water tank 300 includes the tank inlet 308, a tank outlet 328, multiple chambers 310, and the link channel 330. The water tank 300 includes two horizontal columns of chambers 310 with six chambers 310 in one horizontal column and six chambers 310 in another horizontal column. In some examples, FIG. 3A can represent the side view section of the horizontal column shown at the top of FIG. 3B. In some examples, the water tank 300 can include one horizontal column or more than two horizontal columns. Each additional horizontal column can increase capacity without increasing a height of the water tank. The link channel 330 connects the adjacent horizontal columns. Twelve chambers 310 are shown in FIG. 3B, though only one is associated with a numerical indicator in FIG. 3B. Any number of chambers 310 can be included in water tanks according to various aspects. In some examples, each chamber 310 may be structurally identical to the other chambers 310.

As can be seen in the side view section (FIG. 3A) and the top view (FIG. 3B), each chamber 310 can include the chamber inlet port 314, the chamber outlet port 316, and the housing defining a fluid-containing area in the chamber 310. In some examples, the tank inlet 308 is the chamber inlet port 314 of the front chamber 310. In some examples, the tank outlet 328 is the chamber outlet port 316 of the back chamber 310. Each chamber 310 can be fluidly coupled to an immediately preceding or following chamber 310 by a connection channel 312 through at least one of the chamber inlet ports 314 or the chamber outlet ports 316. In some examples, individual chambers 310 can be added or removed to change fluid storage capacity.

Figure 3C:
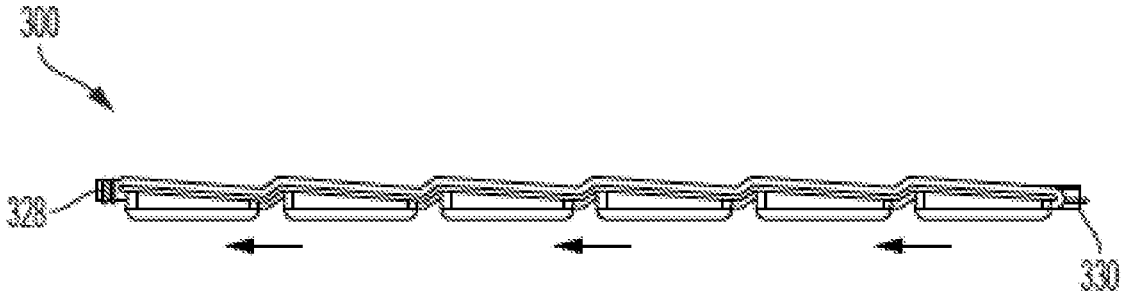
FIG. 3C is a schematic of an upright opposite side view section of the water tank according to one example of the present disclosure.

FIG. 3C is a schematic of an upright opposite side view section of the water tank 300 according to one example of the present disclosure. Arrows depict the direction of water flow within the water tank 300. The water tank 300 includes the tank outlet 328 and the link channel 330. In some examples, FIG. 3C can show the side of the horizontal column depicted in the bottom part of FIG. 3B.

As shown in the top view (FIG. 3B), water can enter the water tank 300 through the tank inlet 308. The water can then pass through a series of chambers 310 in the first horizontal column through the chamber inlet ports 314 and the chamber outlet ports 316. The link channel 330 allows water to flow from the chamber 310 in the first horizontal column that is furthest from the tank inlet 308 to the chamber 310 in the second horizontal column that is furthest from the tank outlet 328. The water can then pass through a series of chambers 310 in the second horizontal column through the chamber inlet ports 314 and the chamber outlet ports 316. The water can exit the water tank 300 through the tank outlet 328.

The water tank 300 can have a relatively small cross-sectional size, which may increase the area exposed to the cold air of the refrigerator. The additional exposed area may more efficiently cool down the water stored in the water tank 300. The small capacity of each of the chambers 310 can help minimize the effect of water recirculation in the water tank 300. When new water enters each chamber 310, the new water may mix with a limited volume of stored water each time to avoid recirculation issues.

As shown in the side view section (FIG. 3A) and the upright opposite side view section (FIG. 3C), a top of each chamber 310 can be slanted upward in the direction of water flow. An angled surface can facilitate air purging. The chamber inlet port 314 of each chamber 310 can be positioned at a lower elevation relative to the chamber outlet port 316. The chambers 310 can have a square, rectangular, or any other cross-section with a substantially flat shape. The water tank 300 can be flat, which can increase an area exposed to cold air of the refrigeration unit. The additional area exposed to the cold air can help reduce the water temperature quickly.

The difference in elevation can allow air to be purged horizontally towards the tank outlet 328. A cross section of each connection channel 312 can be gradually reduced in size in the direction of water flow. The reduction in cross section size of the connection channel 312 can accelerate flow of air/water, pushing fluid into the next chamber 310.

Figure 4:
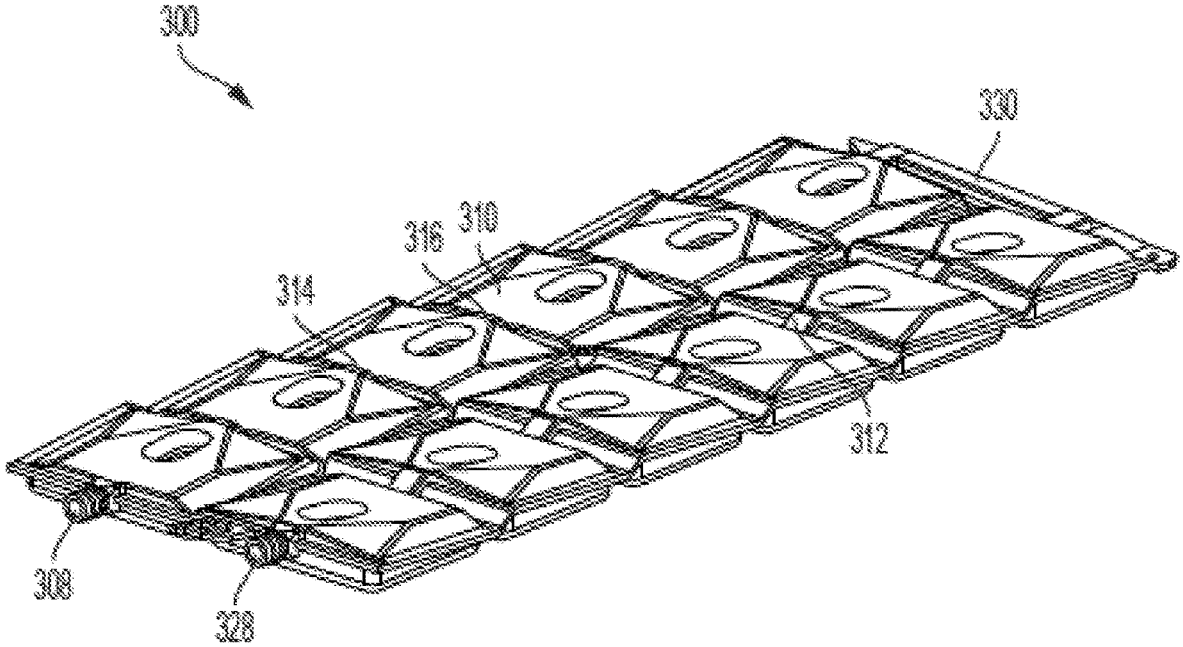
FIG. 4 is a schematic of a perspective view of a water tank according to one example of the present disclosure.

FIG. 4 is a schematic of a perspective view of a water tank 300 according to one example of the present disclosure. The water tank 300 can be positioned in a refrigerator 100, such as the refrigerator 100 shown in FIG. 1 or FIG. 2. The water tank 300 includes a tank inlet 308, a tank outlet 328, multiple chambers 310, and a link channel 330. Twelve chambers 310 are shown in FIG. 4, though only one is associated with a numeral indicator in FIG. 4. The water tank 300 includes two horizontal columns of chambers 310 with six chambers 310 in one horizontal column and six chambers 310 in another horizontal column. Any number of chambers 310 can be included in the water tank 300 according to various aspects. In some examples, there can be more than two horizontal columns with multiple link channels 330. In other examples, there can be a single horizontal column of chambers 310. The link channel 330 can connect the first horizontal column of chambers 310 to the second horizontal column. Each chamber has a chamber inlet port 314 and a chamber outlet port 316. In some examples, the tank inlet 308 is the chamber inlet port 314 of a front chamber 310 and the tank outlet 328 is the chamber outlet port 316 of a back chamber 310. Each chamber 310 is coupled to an immediately preceding or following chamber 310 through a connection channel 312. A top of each chamber 310 can be slanted upward in a direction of water flow. In some examples, chamber geometry can be varied to allow for a plurality of horizontal columns of chambers 310 on a single blow-molded piece.

Figure 5:
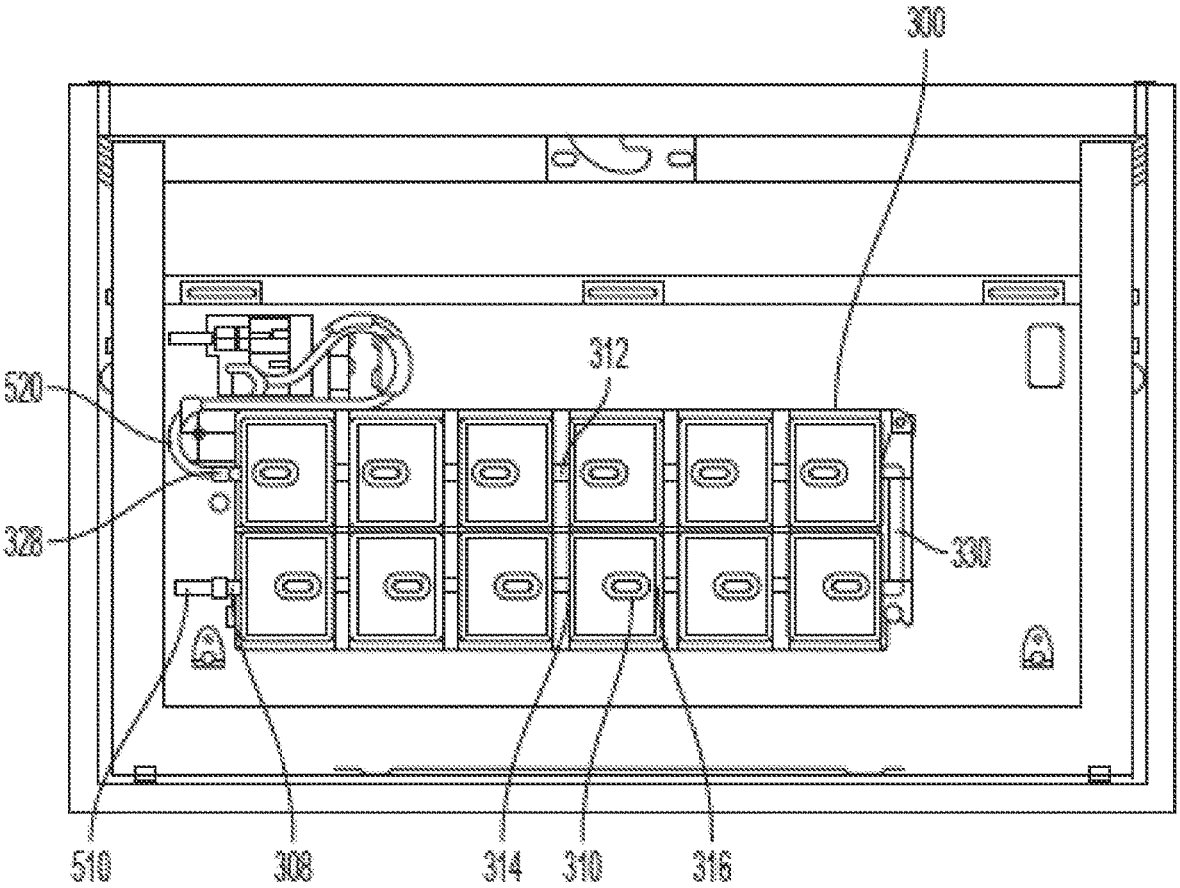
FIG. 5 is a schematic of a bottom view of a water tank assembled within a refrigerator according to one example of the present disclosure.

FIG. 5 is a schematic of a bottom view of a water tank 300 assembled within a refrigerator according to one example of the present disclosure. The figure clarifies a location of an assembled water tank 300 in a top of a refrigeration compartment with top cover removed. The figure displays the assembled water tank 300, which includes a tank inlet 308, a tank outlet 328, and multiple chambers 310. Twelve chambers 310 are shown in FIG. 5, though only one is associated with a numeral indicator in FIG. 5. Each chamber 310 has a chamber inlet port 314 and a chamber outlet port 316. Each chamber 310 is coupled to an immediately preceding or following chamber 310 through a connection channel 312. The multi-chambered water tank is positioned at the top of the refrigerator in a space with a small maximum height limitation (e.g., 25 mm).

The tank inlet 308 is connected to a water supply line 510. Water supplied from an external water supply source is introduced into the water tank 300 at the tank inlet 308 through the water supply line 510. Water exits the water tank 300 through the tank outlet 328 and is sent via a second water supply line 520. The water supply line can distribute water to a built-in water dispenser or an ice maker. The water can be filtered through a water filtration system before reaching the water tank space.

Figure 6:
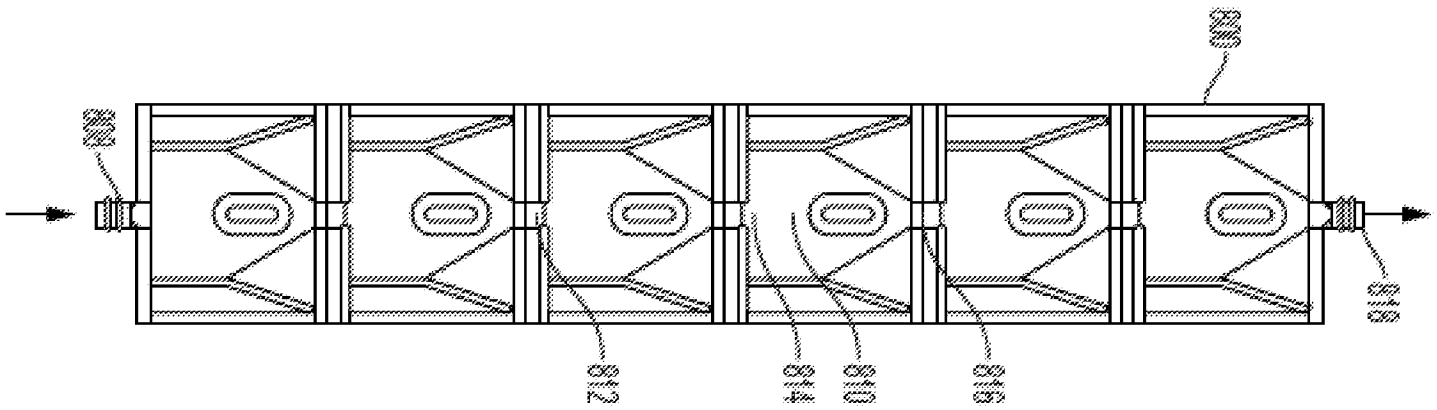
FIG. 6 is a schematic of an example of a vertical water tank according to one example of the present disclosure.

FIG. 6 is a schematic of an example of a vertical water tank 800 according to one example of the present disclosure. Arrows depict a direction of water flow within the vertical water tank 800. The vertical water tank 800 can be positioned along a vertical plane in a refrigerator depicted in FIG. 1 or FIG. 2. The vertical water tank 800 includes a tank inlet 808, multiple chambers 810, and a tank outlet 818. Six chambers 810 are shown in FIG. 6, though only one is associated with a numerical indicator in FIG. 6. In some examples, the vertical water tank can include a single vertical column of chambers 810. Any number of chambers 810 can be included in the vertical water tank 800 according to various aspects. In some examples, each chamber 810 may be structurally identical to the other chambers 810. Individual chambers 810 can be added or removed to change fluid storage capacity.

Each chamber 810 can include a chamber inlet port 814, a chamber outlet port 816, and a housing defining a fluid-containing area in the chamber 810. In some examples, the tank inlet 808 is the chamber inlet port 814 of the bottom chamber 810 and the tank outlet 818 is the chamber outlet port 816 for the top chamber 810. Each chamber 810 can fluidly couple to an immediately preceding or following chamber 810 by a connection channel 812 through at least one of the chamber inlet ports 814 or the chamber outlet ports 816. A cross section of each connection channel 812 can be gradually reduced in size in the direction of water flow.

Water can enter the vertical water tank 800 through the tank inlet 808. The water can then pass through a series of chambers 810 through the chamber inlet ports 814 and the chamber outlet ports 816. The water can exit the water tank through the tank outlet 818.

Figure 7:
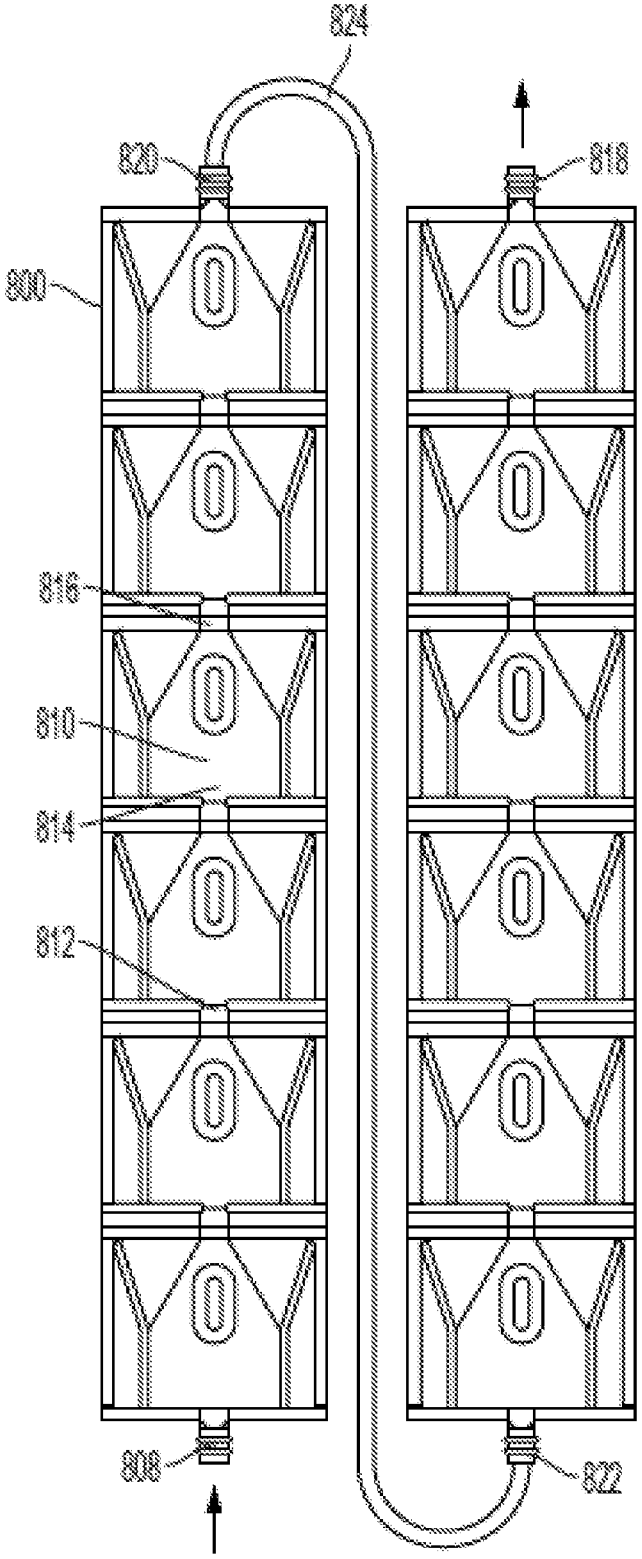
FIG. 7 is a schematic of another example of a vertical water tank according to one example of the present disclosure.

FIG. 7 is a schematic of another example of a vertical water tank 800 according to one example of the present disclosure. Arrows depict a direction of water flow within the vertical water tank 800. The vertical water tank 800 can be positioned in a refrigerator 100, such as the refrigerator 100 depicted in FIG. 1 or FIG. 2. The vertical water tank 800 includes a tank inlet 808, multiple chambers 810, a column outlet 820, a column inlet 822, a tube connection 824, and a tank outlet 818. As depicted in FIG. 7, the vertical water tank 800 can include multiple vertical columns of chambers 810. The tube connection 824 can connect each vertical column to an adjacent vertical column. Twelve chambers 810 (six chambers for each vertical column) are shown in FIG. 7, though only one is associated with a numerical indicator in FIG. 7. Any number of chambers 810 or vertical columns can be included in the vertical water tank 800 according to various aspects. In some examples, each chamber 810 may be structurally identical to the other chambers 810. Individual chambers 810 can be added or removed to change fluid storage capacity.

Each chamber 810 can include a chamber inlet port 814, a chamber outlet port 816, and a housing defining a fluid-containing area in the chamber 810. In some examples, the tank inlet 808 is the chamber inlet port 814 of the bottom chamber 810 in the first vertical column of chambers 810. The tank outlet 818 can be the chamber outlet port 816 for the top chamber 810 of the last vertical column of chambers 810. In some examples, the column outlet 820 is the chamber outlet port 816 of the top chamber 810 in the first vertical column of chambers 810. The column inlet 822 can be the chamber inlet port 814 of the bottom chamber 810 in the second vertical column of chambers. Each chamber 810 can be coupled to an immediately preceding or following chamber 810 by a connection channel 812 through at least one of the chamber inlet ports 814 or the chamber outlet ports 816. A cross section of each connection channel 812 can be gradually reduced in size in the direction of water flow to accelerate flow of fluid.

Water can enter the vertical water tank 800 through the tank inlet 808. The water can then pass through a series of chambers 810 in the first vertical column of chambers 810 through the chamber inlet ports 814 and the chamber outlet ports 816. The water can exit the first vertical column of chambers 810 through the column outlet 820. The water can pass through the tube connection 824 and enter the second vertical column of chambers 810 through the column inlet 822. The water can then pass through a series of chambers 810 in the second vertical column of chambers 810 through the chamber inlet ports 814 and the chamber outlet ports 816. The water can exit the water tank through the tank outlet 818.

Figure 8:
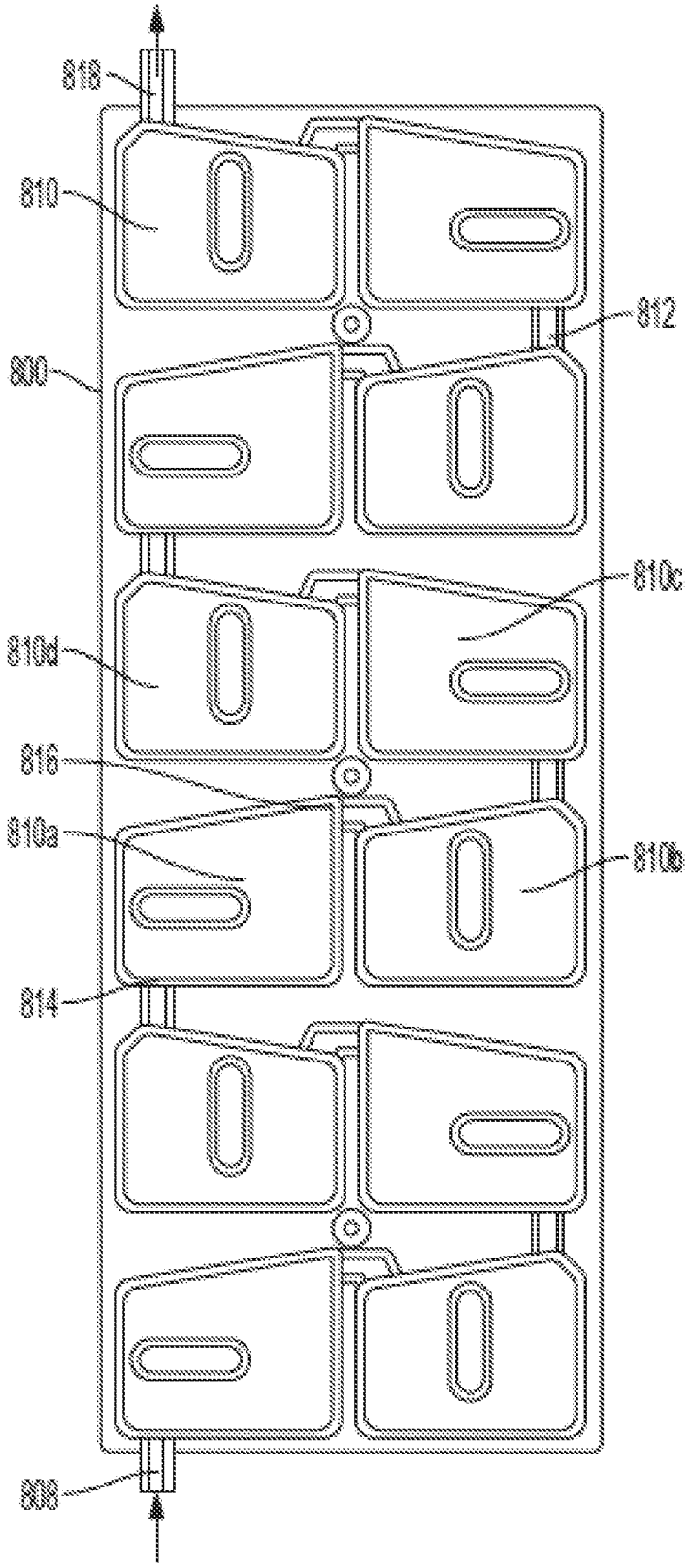
FIG. 8 is a schematic of another example of a vertical water tank according to one example of the present disclosure.

FIG. 8 is a schematic of another example of a vertical water tank 800 according to one example of the present disclosure. Arrows depict a direction of water flow within the vertical water tank 800. The vertical water tank 800 can be positioned in a refrigerator 100, such as the refrigerator 100 depicted in FIG. 1 or FIG. 2. Chamber geometry of the vertical water tank 800 can be varied to allow for multiple columns of chambers 810 on a single blow-molded piece. The vertical water tank 800 includes a tank inlet 808, multiple chambers 810, and a tank outlet 818. As depicted in FIG. 8, water can flow between chambers 810 in the vertical water tank 800 both horizontally and vertically. Twelve chambers 810 are shown in FIG. 8, though only a few are associated with a numerical indicator in FIG. 8. Any number of chambers 810 can be included in the vertical water tank 800 according to various aspects. In some examples, each chamber 810 may be structurally identical to the other chambers 810. Individual chambers 810 can be added or removed to change fluid storage capacity.

Each chamber 810 can include a chamber inlet port 814, a chamber outlet port 816, and a housing defining a fluid-containing area in the chamber 810. In some examples, the tank inlet 808 is the chamber inlet port 814 of the bottom left chamber 810 and the tank outlet 818 is the chamber outlet port 816 for the upper left chamber 810. Each chamber 810 can be coupled to an immediately preceding or following chamber 810 by a connection channel 812 through at least one of the chamber inlet ports 814 or the chamber outlet ports 816. A cross section of each connection channel 812 can be gradually reduced in size in the direction of water flow to accelerate the flow of fluid.

The location of the chamber inlet port 814 and chamber outlet port 816 depends on the design of the chamber 810. There are four different designs for the chambers 810*a-d*. Some chambers 810*a* have the chamber inlet port 814 at the bottom left corner of the chamber 810*a* and the chamber outlet port 816 in the upper right corner of the chamber 810*a*. Other chambers 810*b* have the chamber inlet port 814 at the upper left corner of the chamber 810*b* and the chamber outlet port 816 in the upper right corner of the chamber 810*b*. Certain chambers 810*c* have the chamber inlet port 814 at the bottom right corner of the chamber 810*c* and the chamber outlet port 816 in the upper left corner of the chamber 810*c*. Additionally, chambers 810*d* have the chamber inlet port 814 at the upper right corner of the chamber 810*d* and the chamber outlet port 816 in the upper left corner of the chamber 810*d*. In each of the designs for the chambers 810*a-d*, the top of the chamber is slanted up in the direction of water flow. Also, in each of the designs for the chambers 810*a-d*, the chamber outlet port 816 is elevated vertically above the chamber inlet port 814.

Water can enter the vertical water tank 800 through the tank inlet 808. The water can then pass through a series of chambers 810 through the chamber inlet ports 814 and the chamber outlet ports 816. The water can exit the water tank through the tank outlet 818.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A fluid tank for a refrigeration appliance, the fluid tank comprising:

a plurality of chambers, each chamber of the plurality of chambers comprising:

an inlet port; and an outlet port, at least part of the outlet port being on a horizontal plane that is offset in an upward direction with respect to the inlet port, wherein at least two chambers of the plurality of chambers are configured to fluidly couple in series via a connection channel that has a cross section that gradually reduces in size in a direction of fluid flow to accelerate flow of fluid.

2. The fluid tank of claim 1, wherein each chamber of the plurality of chambers comprises a cross-section with a substantially flat shape such that the fluid tank is positionable in a space within the refrigeration appliance with a maximum height of 25 mm.

3. The fluid tank of claim 1, wherein each chamber of the plurality of chambers comprises a top surface that is angled upward in a direction of fluid flow through the fluid tank.

4. The fluid tank of claim 1, wherein the fluid tank is configured to be positioned in a horizontal plane in the refrigeration appliance, the fluid tank further comprising:

at least one link channel; and wherein the plurality of chambers include a plurality of horizontal columns of chambers, wherein each horizontal column of the plurality of horizontal columns is connected to an adjacent horizontal column by the at least one link channel.

5. The fluid tank of claim 1, wherein the fluid tank is configured to be positioned along a vertical plane in the refrigeration appliance, the fluid tank further comprising:

at least one tube connection; and wherein the plurality of chambers include a plurality of vertical columns of chambers, wherein each vertical column of the plurality of vertical columns is connected to an adjacent vertical column by the at least one tube connection.

6. The fluid tank of claim 5, wherein each chamber of the plurality of chambers is configured to allow for a plurality of vertical columns on a single blow-molded piece.

7. A method comprising:

fabricating a plurality of chambers of a fluid tank for a refrigeration appliance;

constructing an inlet port in each chamber of the plurality of chambers;

constructing an outlet port in each chamber of the plurality of chambers, at least part of the outlet port being on a horizontal plane that is offset in an upward direction with respect to the inlet port; and fluidly coupling in series at least two chambers of the plurality of chambers via a connection channel that has a cross section that gradually reduces in size in a direction of fluid flow to accelerate flow of fluid.

8. The method of claim 7, wherein each chamber of the plurality of chambers comprises a cross-section with a substantially flat shape.

9. The method of claim 7, wherein each chamber of the plurality of chambers comprises a top surface that is angled upward in a direction of fluid flow through the fluid tank.

10. The method of claim 7, wherein the plurality of chambers comprises a plurality of horizontal columns of chambers, and wherein the method further comprises:

forming at least one link channel; and connecting at least one horizontal column of chambers of the plurality of horizontal columns of chambers to an adjacent horizontal column of the plurality of horizontal columns of chambers by the at least one link channel.

11. The method of claim 7, wherein the plurality of chambers comprises a plurality of vertical columns of chambers, and wherein the method further comprises:

forming at least one tube connection; and connecting at least one vertical column of chambers of the plurality of vertical columns of chambers to an adjacent vertical column of the plurality of vertical columns of chambers by the at least one tube connection.

12. The method of claim 11, wherein each chamber of the plurality of chambers is configured to allow for a plurality of vertical columns on a single blow-molded piece.

13. A refrigeration appliance comprising:

a fresh food compartment;

a fluid tank configurable to be positioned in the fresh food compartment comprising:

a plurality of chambers, each chamber of the plurality of chambers comprising:

an inlet port; and an outlet port, at least part of the outlet port being on a horizontal plane that is offset in an upward direction with respect to the inlet port, wherein at least two chambers of the plurality of chambers are configured to fluidly couple in series via a connection channel that has a cross section that gradually reduces in size in a direction of fluid flow to accelerate flow of fluid.

14. The refrigeration appliance of claim 13, wherein each chamber of the plurality of chambers comprises a cross-section with a substantially flat shape.

15. The refrigeration appliance of claim 13, wherein each chamber of the plurality of chambers comprises a top surface that is angled upward in a direction of fluid flow through the fluid tank.

16. The refrigeration appliance of claim 13, wherein the fluid tank is configured to be positioned in a horizontal plane in the fresh food compartment, the fluid tank further comprising:

at least one link channel; and wherein the plurality of chambers comprises a plurality of horizontal columns of chambers, wherein each horizontal column of the plurality of horizontal columns is connected to an adjacent horizontal column by the at least one link channel.

17. The refrigeration appliance of claim 13, wherein the fluid tank is configured to be positioned along a vertical plane in the fresh food compartment, the fluid tank further comprising:

at least one tube connection; and wherein the plurality of chambers comprises a plurality of vertical columns of chambers, wherein each vertical column of the plurality of vertical columns is connected to an adjacent vertical column by the at least one tube connection.

* * * * *